US007073557B2

(12) United States Patent
Franklin et al.

(10) Patent No.: US 7,073,557 B2
(45) Date of Patent: Jul. 11, 2006

(54) METHOD OF DRYING A SAND MOLD USING A VACUUM

(75) Inventors: Daniel L. Franklin, Austin, MN (US); Richard M. Herreid, Austin, MN (US)

(73) Assignee: Hormel Foods, LLC, Austin, MN (US)

( * ) Notice: Subject to any disclaimer, the term of this patent is extended or adjusted under 35 U.S.C. 154(b) by 0 days.

(21) Appl. No.: 10/781,397

(22) Filed: Feb. 18, 2004

(65) Prior Publication Data

US 2005/0178520 A1 Aug. 18, 2005

(51) Int. Cl.
*B22C 9/00* (2006.01)

(52) U.S. Cl. ..... 164/7.1; 164/12; 164/160.1; 164/5

(58) Field of Classification Search ..... 164/7.1, 164/12, 160.1, 253, 254, 5.1, 5
See application file for complete search history.

(56) References Cited

U.S. PATENT DOCUMENTS

| | | | | | |
|---|---|---|---|---|---|
| 2,145,317 | A | | 1/1939 | Salzberg | 22/188 |
| 4,064,926 | A | | 12/1977 | Naegele | 164/154 |
| 4,158,381 | A | | 6/1979 | Michelson | 164/226 |
| 4,226,277 | A | * | 10/1980 | Matalon | 164/7.1 |
| 4,867,228 | A | | 9/1989 | Novelli et al. | 164/525 |
| 4,947,923 | A | * | 8/1990 | Rikker | 164/5 |
| 5,014,763 | A | | 5/1991 | Frank | 164/15 |
| 5,262,100 | A | | 11/1993 | Moore et al. | 264/25 |
| 5,320,157 | A | * | 6/1994 | Siak et al. | 164/12 |
| 5,365,995 | A | | 11/1994 | Warner | 164/12 |
| 5,580,400 | A | | 12/1996 | Takahashi | 148/302 |
| 5,580,624 | A | | 12/1996 | Andersen et al. | 428/34.5 |
| 5,582,231 | A | | 12/1996 | Siak et al. | 164/525 |
| 5,715,885 | A | | 2/1998 | Nagarwalla et al. | 164/20 |
| 5,749,409 | A | | 5/1998 | Siak et al. | 164/23 |
| 5,837,373 | A | | 11/1998 | Siak et al. | 428/404 |
| RE36,001 | E | | 12/1998 | Siak et al. | 164/525 |
| 6,016,862 | A | | 1/2000 | Herreid | 164/525 |
| 6,090,915 | A | | 7/2000 | Herreid | 530/350 |
| 6,467,525 | B1 | | 10/2002 | Herreid et al. | 164/12 |
| 6,505,671 | B1 | | 1/2003 | McKibben et al. | 164/12 |
| 6,666,253 | B1 | | 12/2003 | Herreid et al. | 164/20 |
| 6,843,303 | B1 | * | 1/2005 | Siak et al. | 164/12 |

FOREIGN PATENT DOCUMENTS

| | | |
|---|---|---|
| EP | 0 221 537 | 5/1987 |
| EP | 0 371 895 A2 | 6/1990 |

(Continued)

OTHER PUBLICATIONS

Wile, "Coremaking," ASM Handbook, Formerly Ninth Edition, Metals Handbook ASM International, vol. 15 Casting, The Materials Information Society, Materials Park, OH; pp. 238-241.

(Continued)

*Primary Examiner*—Kevin Kerns
*Assistant Examiner*—I.-H. Lin
(74) *Attorney, Agent, or Firm*—IPLM Group, P.A.

(57) ABSTRACT

A method of drying a sand mold mixture containing moisture includes restraining the sand mold mixture and exposing the sand mold mixture to a vacuum. The vacuum flashes off the moisture within the sand mold mixture thereby drying the sand mold mixture to create a solidified sand mold. The restraining member prevents voids from forming in the sand mold during exposure to the vacuum.

22 Claims, 7 Drawing Sheets

FOREIGN PATENT DOCUMENTS

| | | |
|---|---|---|
| EP | 0 608 926 A1 | 8/1994 |
| EP | 0 780 175 A1 | 6/1997 |
| WO | WO 98/17738 | 4/1998 |

OTHER PUBLICATIONS

Mold & Core Test Handbook; 3rd Edition; 2001.

Eastman, J., "Protein-Based Binder Update: Performance Put to the Test," *Modern Casting*, pp. 32-34 (Oct. 2000).

Ferrero, A. et al., "New Binder for Casting Cores: An Industrial Application to Safety Suspension Parts," *SAE Technical Paper Series, International Congress and Exposition, Detroit, Michigan*, Paper No. 981005 (pp. 1-6) (Feb. 23-26, 1998).

Mus, C. et al., "Innovative Foundry Technologies for Safety Aluminum Suspension Parts and Complex Castings," *SAE Technical Paper Series, SAE World Congress, Detroit, Michigan*, Paper No. 2001-01-0407 (8 pgs.) (Mar. 5-8, 2001).

* cited by examiner

Vacuum Chamber and Connections

FIG. 5
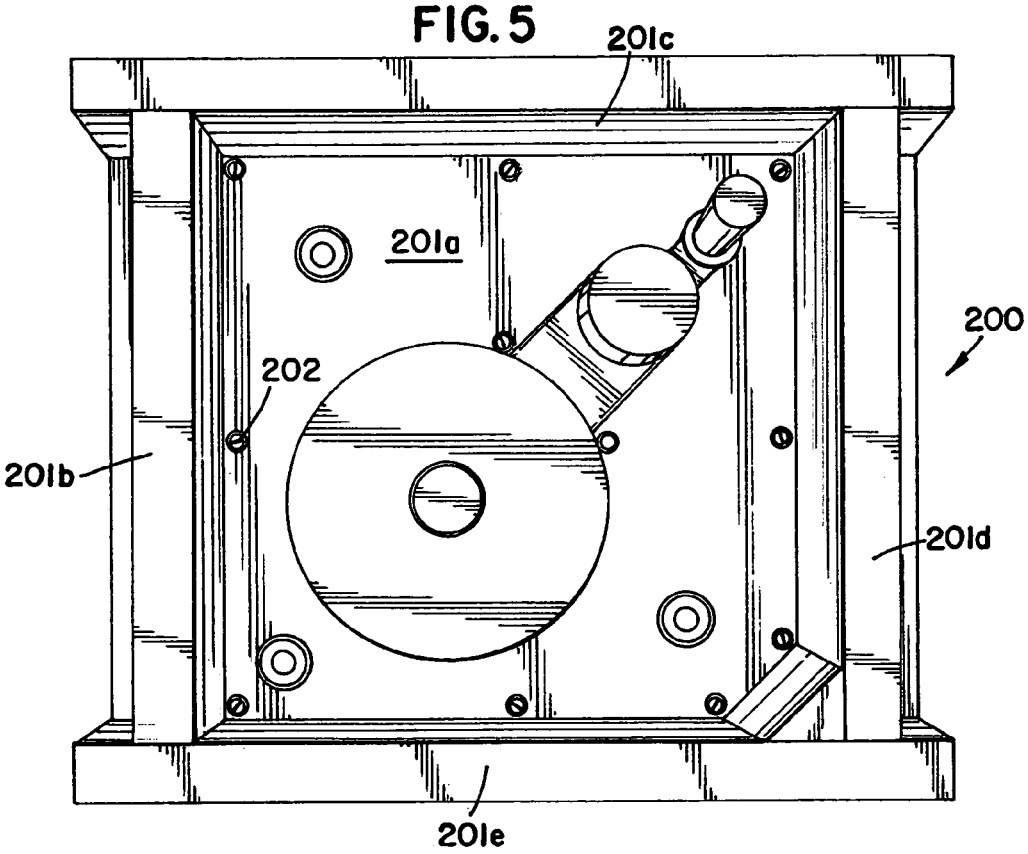
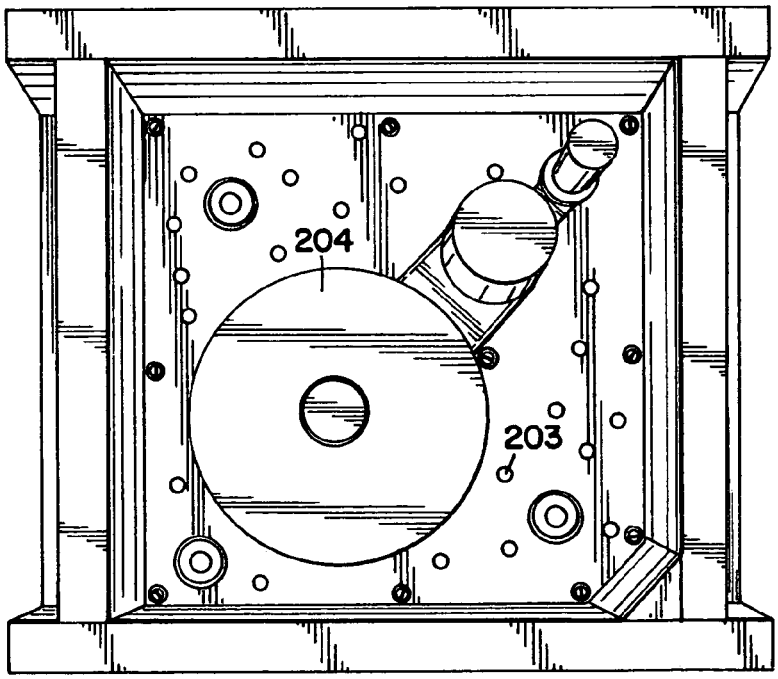
FIG. 6

METHOD OF DRYING A SAND MOLD USING A VACUUM

BACKGROUND OF THE INVENTION

1. Field of the Invention

The present method relates to the drying of a sand mold using a vacuum.

2. Description of the Prior Art

Cores and molds used in metal casting consist of a mass of refractory aggregate bound together to form a shape used as a pattern for molten metal during the casting process. The aggregate is typically coated with a binding material and then formed into a shape using a pattern. The binding material is typically hardened to hold the aggregate in the desired shape so the core or mold can be removed from the pattern. The core or mold is then used in giving shape to molten metal so that the metal takes the shape of the original pattern when the metal cools. In common usage, the mold forms the outer surface of the casting and the cores are used to form interior passages in the casting.

Sand molds made with no-bake binders can be very large, up to several hundred pounds of sand. Sand molds are typically made in open pattern boxes with the pattern on the bottom of the pattern box. After metal casting, the sand molds should be discarded or thermally reclaimed. The use of protein binder to bind the sand allows for partial recycling of unburned sand and binder. However, the procedure in the prior art patents disclosing the use of vacuum to dry sand molds does not work when the drying time is reduced to that of traditional binders because the vacuum level must be reduced thereby causing the sand molds to pop and crack severely.

Prior art includes patents on protein binder technology, including U.S. Pat. Nos. 5,320,157 and 5,582,231 to Siak et al. U.S. Pat. No. 5,320,157 discloses using a vacuum while a sand core is still at an elevated temperature after curing, such as about 70 to 80° C., to remove residual water from the core. A vacuum of at least about 101 Pascals, and more preferably from about 96.5 to 101 Pascals (0.72 to 0.76 Torr), for a duration of about 5 to 10 minutes is generally sufficient for this purpose. U.S. Pat. No. 5,582,231 discloses the use of standard core blowing equipment and air to dry the sand core. Traditional core machines with purge air have airflow from top to bottom, as indicated in the chapter on core making in *ASM Handbook, Formerly Ninth Edition, Metals Handbook, Volume* 15, *Casting* (1988).

The present invention allows for the use of a vacuum to dry sand molds made with no-bake binders which are hardened by solvent removal in a reduced amount of time without resulting in cracks or voids in the sand molds.

SUMMARY OF THE INVENTION

In a preferred embodiment method of making a sand mold, a sand mold mixture containing moisture is placed into a pattern, and the sand mold mixture is restrained in the pattern. The sand mold mixture is exposed to a vacuum, the vacuum being low enough to flash off the moisture in the sand mold mixture thereby drying the sand mold mixture to create a sand mold, and the restrained sand mold mixture preventing voids in the sand mold.

In a preferred embodiment method of making a sand mold, a sand mold mixture containing moisture is placed into a pattern, and a restraining member is placed onto the pattern, the restraining member restraining the sand mold mixture within the pattern. The restrained sand mold mixture filled pattern is exposed to a vacuum, the vacuum being low enough to flash off the moisture in the sand mold mixture thereby drying the sand mold mixture to create a sand mold, and the restraining member preventing voids in the sand mold.

In a preferred embodiment method of making a sand mold, a sand mold mixture containing moisture is placed into a pattern, and the sand mold mixture is restrained in the pattern by placing a perforated lid on the pattern, the perforated lid having apertures with a hydraulic radius of 0.5 inch or less. The pattern containing the sand mold mixture is exposed to a vacuum, the vacuum being low enough to flash off the moisture in the sand mold mixture thereby drying the sand mold mixture to create a sand mold, and the restraining member preventing voids in the sand mold.

BRIEF DESCRIPTION OF THE DRAWINGS

FIG. 5 is a top view of a cope pattern box with vents;

FIG. 6 is a top view of the cope pattern box shown in FIG. 5 with additional vents;

DETAILED DESCRIPTION OF THE PREFERRED EMBODIMENT

Figure 1:
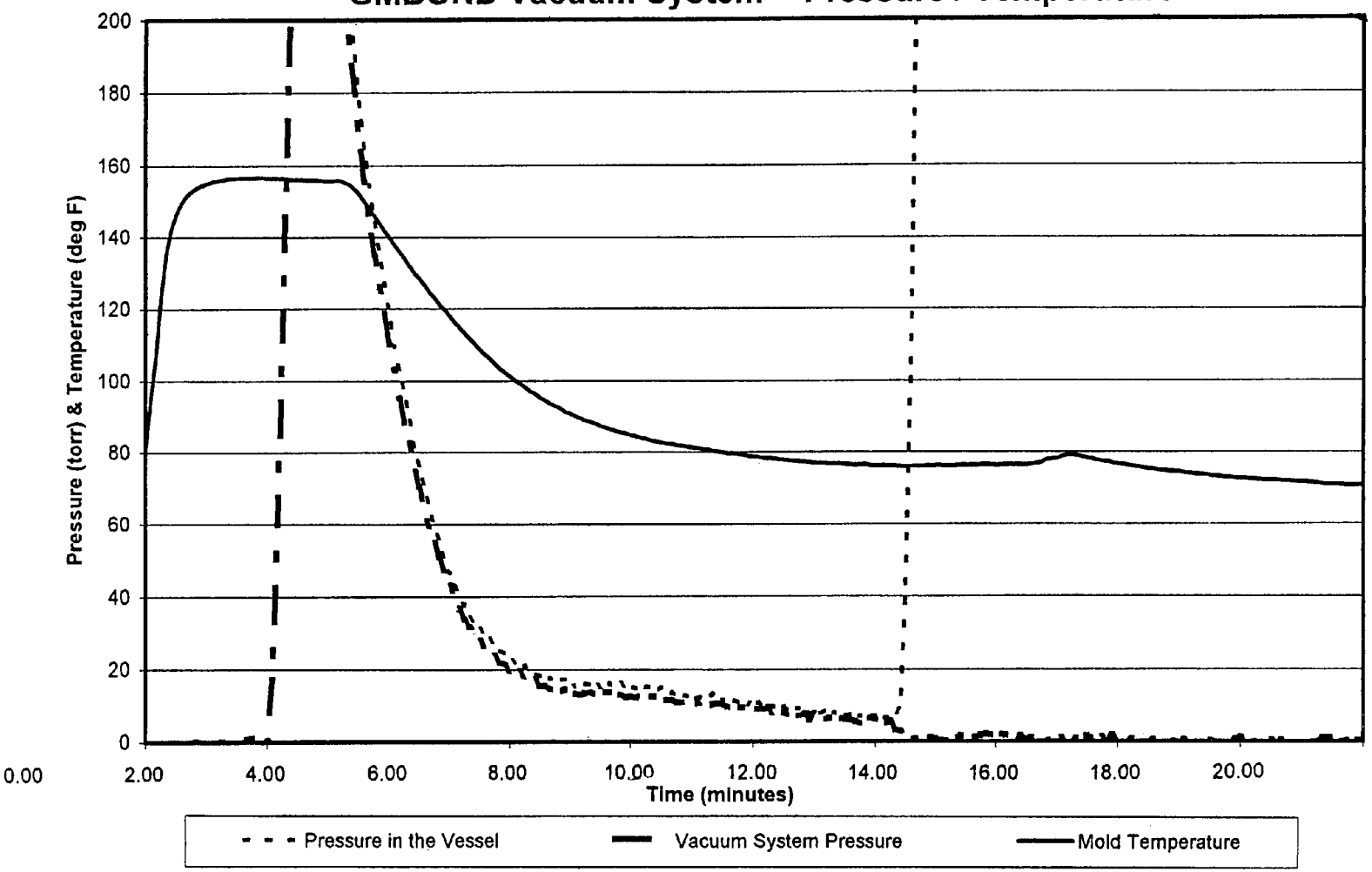
FIG. 1 is a graph showing the pressure and the temperature of a sand mold mixture over time during vacuum drying.

The present invention allows for the use of protein binder in large no-bake molds by providing a practical way to dry the molds in a reduced amount of time using a perforated lid or restraining member to restrain the sand during vacuum drying. In addition, the present invention utilizes a warm protein binder coated sand and water mixture to fill the mold pattern box so that the box does not need to be heated. Because the use of heat is not required after the box has been filled, plastic, metal, or wood pattern boxes, which are common in the industry, could be used with this process.

Although protein is described herein, the present invention is not limited to using protein as a binder. The present invention includes water-based binders such as casein, glues, and others well known in the art. It is also possible to use a solvent-based binder that evaporates or is drawn off during the drying process. The term moisture is used throughout to refer to water, solvent, or any other compound known in the art in a binder that evaporates to solidify the binder. The present invention does not require the use of ferric oxide. In the preferred embodiment, sand is used as the aggregate but it is recognized that any refractory aggregate such as ceramic or synthetic beads or any other suitable aggregate known in the art could also be used.

The present invention is not limited to making sand molds. The present invention may also be used to make sand cores. Further in this regard, either large or small molds or cores may be made with the present invention. The present invention is particularly useful for larger sand molds or cores because they may weigh up to several thousand pounds and, therefore, are difficult to dry. Although the term mold is used throughout, it is understood that molds or cores may be made using the present invention.

In the preferred embodiment, protein binder coated sand is preferably heated to approximately 180 to 200° F. Then, moisture, preferably water, is added to the protein binder coated sand in a continuous mixer, and the mold pattern box is filled directly from the mixer. A pattern box such as those shown in FIGS. 5–7 may be used. Some heat loss may occur during the mixing and the pouring. The protein binder coated sand and water mixture is preferably approximately at least 140° F. when poured into the pattern box to assist in evaporating the moisture with the vacuum without applying heat to the mold. Alternatively, rather than adding water to protein binder coated sand, heated sand could be mixed with a solution of protein binder and water prior to filling the mold pattern box.

The vacuum lowers the absolute pressure within the mold so the water flashes off the mixture even though the temperature is reduced in the sand. In other words, the vacuum reduces the boiling point of the water and the heat already in the mixture is used to dry the mold. More moisture can be withdrawn from the mold faster using a higher temperature mixture and a stronger vacuum. Therefore, to assist in drying the mold quickly, the sand should be as hot as possible when it is placed in the pattern box.

Figure 7:
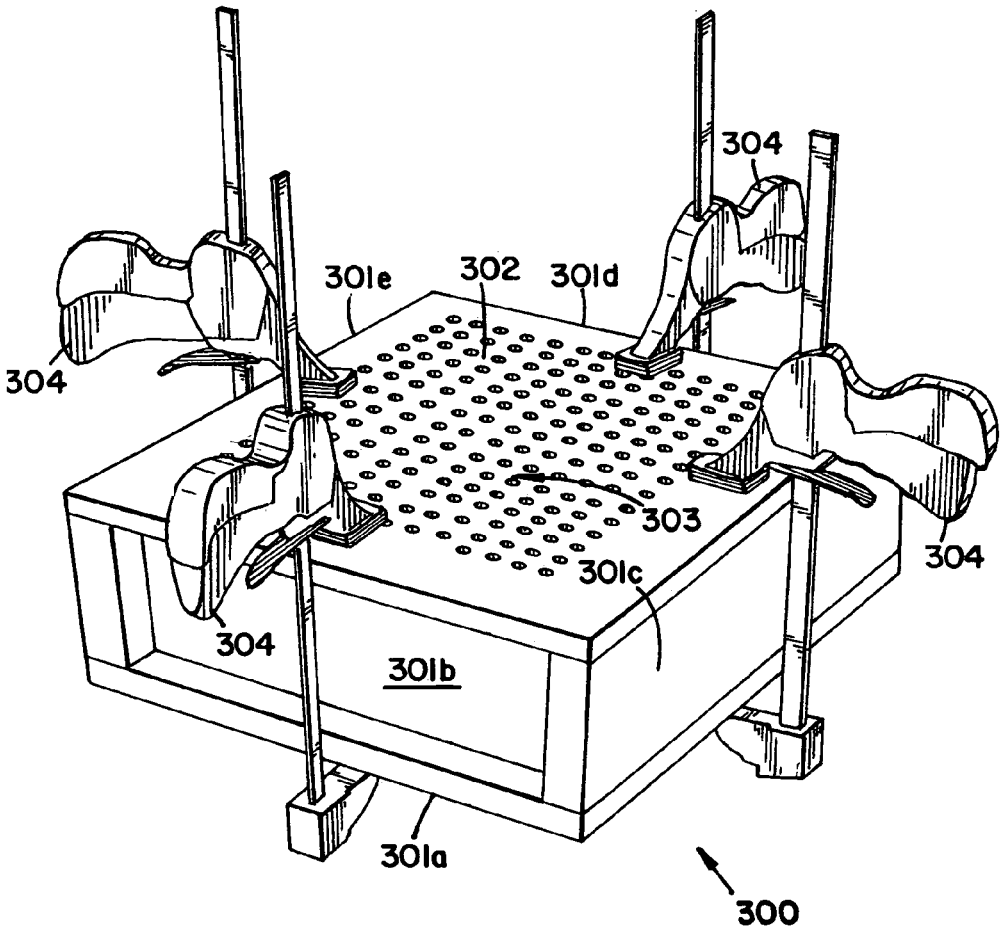
FIG. 7 is a perspective view of a pattern box and a perforated lid clamped thereto constructed according to the principles of the present invention.

As shown in FIG. 7, a perforated lid or restraining member 302 with apertures 303 is then preferably operatively connected to the pattern box 300 with a clamp 304, and the pattern box 300 is placed in a vacuum chamber. Alternatively, the pattern box may include a vacuum manifold, which is connected to a vacuum source. The pattern box 300 contains the sand mold mixture on five sides and the restraining member contains the sand mold mixture on the sixth side. The bottom 301*a* and sides 301*b*–*e* are shown in FIG. 7. In other words, the sand mold mixture is restrained on all sides by the pattern box 300 and the restraining member 302.

The term restraining means containing the sand mold mixture on all sides with apertures large enough to allow vapor to escape but small enough to contain the sand mold mixture. The sand mold mixture is contacted on all sides with the pattern box and the restraining member to compress, restrain, and/or contain the sand mold mixture thereby inhibiting movement of the sand mold mixture while concurrently allowing vapor to escape. Preferably, the hydraulic radius of the apertures is 0.5 inch or less, the hydraulic radius being the area of the aperture divided by the perimeter of the aperture. The apertures may be square, round, rectangular, triangular, or any other suitable shape. However, it is recognized that smaller holes should preferably be used with larger pattern boxes. When the pattern boxes get very large, vents may have to be placed over the apertures. Also, it is recognized that the size of the apertures depend largely upon the size and/or the porosity of the sand particles used. Therefore, in order for the moisture to escape the sand mold mixture, the sand particles may be moved/separated by the moisture thereby creating cracks and/or voids in the sand mold if no restraining member is used, especially if the moisture is drawn off too quickly.

A vacuum is drawn to dry the mold. The heat in the protein binder coated sand and water mixture has enough energy to completely dry the mold without heating the pattern box during the vacuum application. Air may optionally be blown through the mold to assist in drying the mold by assisting in evaporating the water in the mold. The vacuum is released, and the pattern box is removed from the vacuum chamber. The mold is then removed from the pattern box. Typically, it will take approximately 5 to 7 minutes to dry a 50 pound mold. The mold is dried sufficiently while in the mold form, and no additional baking is required afterward.

Using prior art processes for drying sand molds with a vacuum without restraining the sand on all sides, a vacuum level of less than 100 Torr would result in popping and/or cracking of the sand mold. If the vacuum level was too high, the water in the mold would boil too quickly and the mold would become deformed because some of the sand would be blown apart. The present method uses a vacuum level of preferably 4 to 5 Torr. As the vacuum level is lowered, the pressure within the sand mold is lowered and the temperature at which water boils is also lowered. The lowest (strongest) vacuum level should be used to dry the sand mold more quickly. Preferably, the sand mold is dried within 5 to 30 minutes, depending upon the size of the sand mold. If just air is used without heat or vacuum, then it is difficult to dry the sand mold in this short period of time.

The lid or restraining member preferably has apertures having hydraulic radii of 0.5 inch or less that are uniformly spaced. The apertures should be spaced apart a distance large enough to maintain the integrity of the sand mold surface. The apertures could be squares, circles, slots, triangles, etc. as long as the sand is sufficiently restrained. Alternatively, a screen-type member could be used as the lid or restraining member. The lid or restraining member is used to uniformly restrain the sand during the application of the vacuum at lower vacuum levels to reduce the drying time while preventing cracks and/or voids from forming in the sand mold. The lid or restraining member helps contain the sand and allows moisture to be drawn out of the sand mold quickly without disturbing the surface of the sand mold. In addition, the lid maintains the pressure inside the mold at a level such that the water that vaporizes at the maximum rate can pass through the sand without causing popping and/or cracking of the sand mold. The terms popping and cracking and the terms cracks and voids are used interchangeably throughout to indicate the many types of defects that may occur in the sand mold during vacuum drying of the sand mold.

U.S. Pat. Nos. 5,320,157 and 5,582,231 to Siak et al. do not include using a lid or restraining member during the drying process, which is important for preventing cracks and/or voids in the molds when drying them quickly. The vacuum levels disclosed in U.S. Pat. No. 5,320,157 (96.5 to 101 Pascals (0.72 to 0.76 Torr)) are lower than those preferably used in the present invention, and these lower levels would result in even worse cracks and/or voids during the drying process without restraining the sand. Therefore, the present invention uses vacuum to assist in rapidly drying large molds without producing cracks and/or voids in the molds.

It is of course recognized that other suitable parameters may be utilized in the process of the present invention to achieve the desired results. For example, it is recognized that the level of vacuum, the time the vacuum is applied, the number and dimensions of the apertures in the lid or restraining member, and the binder level in the mixture will depend upon the size of the mold or core, the surface area of the sand, the temperature of the mixture, the amount of moisture in the mixture, and the porosity of the sand. Other modifications of the invention will be apparent to those skilled in the art in light of the foregoing description. This description is intended to provide specific examples of individual embodiments disclosed by the present invention. Accordingly, the invention is not limited to these embodiments or the use of elements having specific configurations and shapes as presented herein. Results from various tests performed to determine the effectiveness of the present invention are as follows. Unless otherwise indicated, the percentages (e.g. binder levels and moisture levels) are based on the weight of sand.

EXAMPLE 1

A large vacuum bell was constructed to test the practical application of vacuum drying of no-bake molds in a system that could be used in foundries. A sand heater, a continuous mixer, the vacuum bell, and mold patterns designed for shake-out test casting were used. The dimensions of the cope were 14 ½ by 14 ½ by 5 inches, and the dimensions of the drag were 14 ½ by 14 ½ by 3 ⅛ inches. The cope of the mold held about 50 pounds of sand while the drag held about 30 pounds of sand. The patterns were wooden with eleven ½ inch slot vents in each box.

The vacuum chamber was about 6 feet in diameter and about 6 feet tall with a metal grate about 12 inches above the bottom of the chamber to support the pattern boxes. The vacuum pump used was a liquid ring pump with a 10 HP motor and a booster pump operated at 50% full speed on top of the liquid ring pump. There was a glycol cooled condenser and sand filter in the 6 inch line between the vacuum chamber and the vacuum pups. Pressure sensors were mounted in the chamber and in the vacuum line. A valve was closed in the vacuum line at the outlet of the chamber. Maximum vacuum was achieved in the vacuum line of about 1 Torr, measure by the pressure sensor in the vacuum line. With the pattern boxes in the chamber and the bell lowered, the vacuum valve was opened over 45 to 60 seconds to evacuate the chamber. The valve had to be slowly opened to avoid overloading the booster pump since both vacuum pumps were running during this process.

Three different batches of protein binder coated sand were used in these tests. Each batch used a coating of approximately 0.75% based on sand weight. In one batch, lake sand of about 55 gfn and 520 silica sand (about 63 gfn) was coated with a reduced strength protein binder so the dog bone tensile strengths were less than about 100 pounds. In another batch, 520 silica sand was coated with 0.75% protein binder and had a tensile strength of about 250 pounds. The coated sand was heated in the sand heater with a set point of 180° F., and the actual sand temperature was about 200° F.

A Palmer continuous mixer was used to mix water with the hot sand prior to filling the pattern boxes. The mixer was run at 30 Hz on a speed control, which gave a sand flow rate of about 160 pounds per minute. The water was pumped into the mixer and thoroughly mixed with the sand. The wet sand came out of the mixer directly into the pattern boxes where it was hand rammed and leveled within about one minute. During the mixing of the water with hot sand, some of the water evaporated. Generally, the evaporation was about 0.35 to 0.55% based on the amount of sand. After the sand was packed into the pattern boxes, a sample of sand was collected from the mixer and placed in a whirl pack bag for moisture measurement.

The pattern boxes were either left open or had a vented cover or lid clamped onto the open top and then weighed. The boxes were put on the grate in the vacuum chamber, and temperature probes were inserted through the side of the boxes. Two probes were inserted into the larger cope box approximately 2 inches from the top and approximately 4 inches from the top and one probe was inserted into the drag box. The vacuum pumps were started and a full vacuum drawn in the pipes up to the valve proximate the vacuum chamber before the boxes were placed inside the vacuum chamber. After the boxes were placed inside the vacuum chamber, the top was lowered and the vacuum valve was slowly opened. The valve was fully opened in about 45 to 60 seconds. The vacuum drying was continued for 10 to 15 minutes and the valve was closed to isolate the chamber from the vacuum system. The vacuum was then released in the chamber over about 20 seconds. The chamber was opened, the boxes were removed and weighed, and the molds were removed from the boxes. Surface scratch hardness was measured on the pattern surface of the molds. During the tests, a Hyperlogger data recorder was used to collect data points every 5 seconds.

Figure 2:
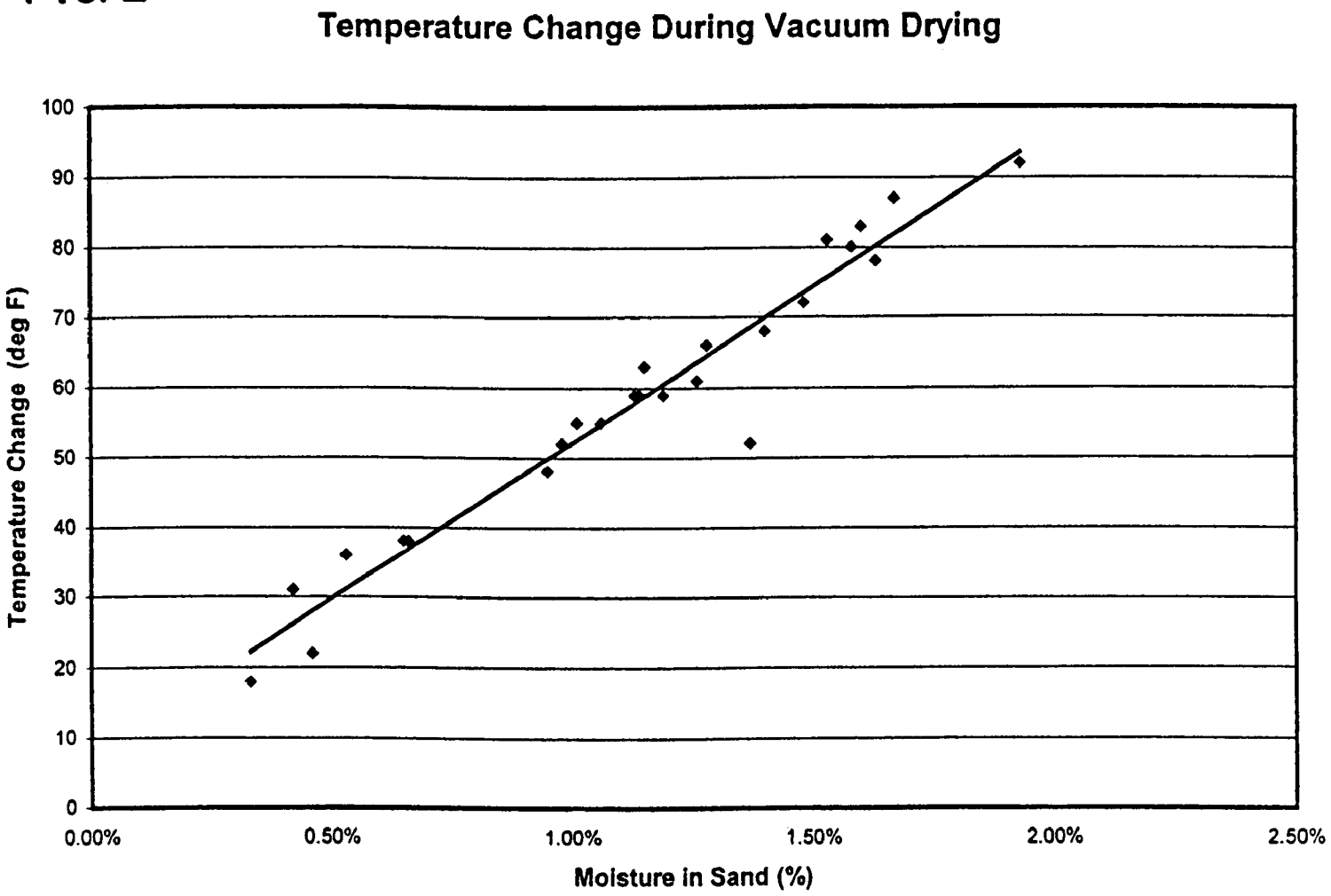
FIG. 2 is a graph showing the temperature change during vacuum drying as the percentage of initial moisture decreases in a sand mold mixture.

With approximately 2% water added to hot sand (180 to 200° F.) coated with 0.75% protein binder prior to filling a no-bake mold, there is enough energy in the water and sand combination to evaporate the moisture present when a vacuum is applied. The temperature of the mold in the pattern box declines rapidly during vacuum drying, and the temperature change is proportional to the amount of moisture in the sand, as shown in FIG. 2. The moisture values shown in FIG. 2 are the actual percentages of moisture in the sand during vacuum drying. Typically, about 0.35 to 0.55% more moisture is added to the sand in the mixer but evaporates during the mixing process. The energy present in the sand to dry the molds under vacuum is sufficient to dry sand including up to about 2% moisture.

One way to determine the quality of the mold is to measure the surface hardness of the mold, which may be measured by scratch hardness. To reach maximum surface hardness on the mold face, at least 1.5% moisture in the mixture within the pattern box is required. With above 1.5% moisture, there is no significant increase in hardness. The scratch hardness ratio for various moisture levels in the sand coated with 0.75% protein binder was determined by calculating the ratio of the penetration reading after two turns to the penetration reading after one turn. The larger the number, the harder the surface, and the maximum possible ratio is 1.0. A George Fisher Scratch Hardness instrument was used against a flat surface on the mold.

Figure 3:
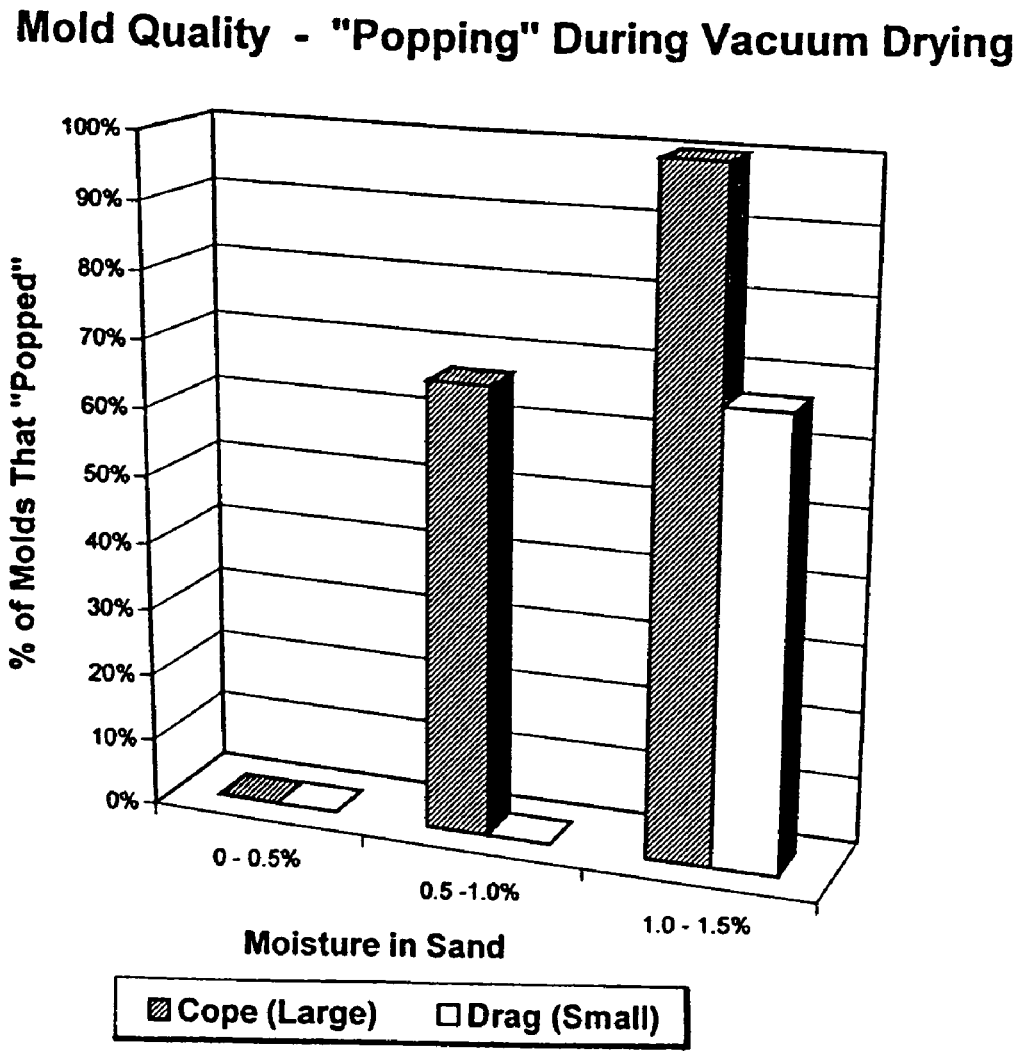
FIG. 3 is a bar graph showing the sand mold quality of sand molds containing different percentages of moisture during vacuum drying made without a restraining member.
Figure 8:
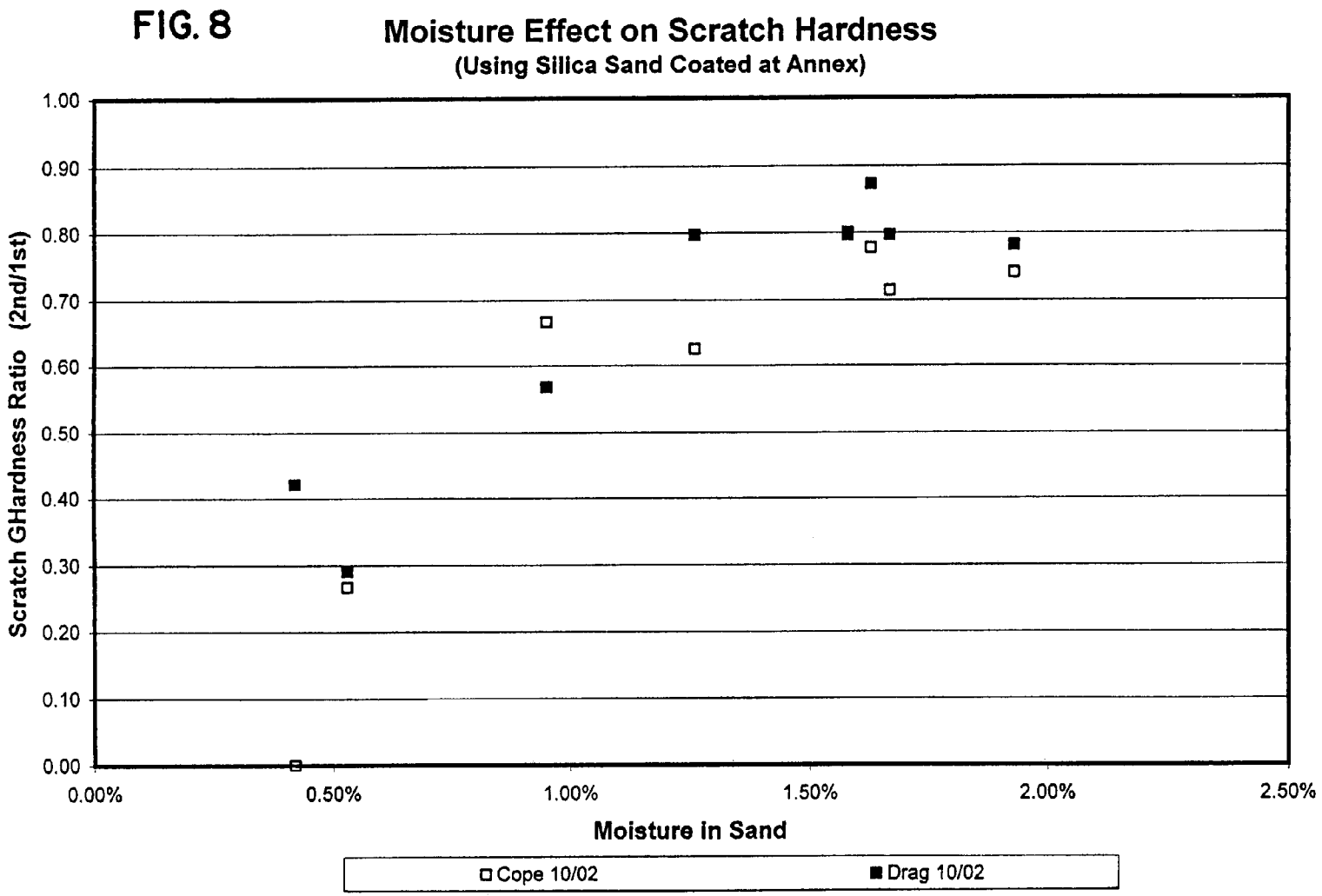
FIG. 8 is a graph showing the initial moisture effect on scratch hardness of sand molds.

However, at moisture levels above approximately 0.5%, the moisture in the mold is apparently converted to steam too quickly for the steam to pass through the sand and the sand pops or cracks as the mold breaks to allow the steam to escape. At moisture levels between 0.5 and 1.0%, the cope popped more frequently than the drag. The moisture levels where popping of both the cope and the drag frequently occurred in an open pattern box were approaching the 1.0 to 1.5% moisture level, which is the moisture level necessary to make a hard mold. This is shown in FIG. 3. However, the popping and cracking is prevented by using a perforated board as a cover or lid clamped onto the cope of the pattern box. When the lid is used, molds with up to 2% moisture in the sand could be made in the pattern box. A QUICK-GRIP™ clamp was used to clamp the lid onto the pattern box, as shown in FIG. 7. The scratch hardness ratio for various moisture levels in the sand coated with 0.75% protein binder is shown in FIG. 8.

These test results indicate that strong molds could be made with heated 0.75% protein binder coated sand mixed with approximately 1.5% (up to 2.0%) water in a continuous mixer as the pattern box is filled. The vacuum was applied to the filled pattern box to dry the mold in approximately 5 minutes. A perforated lid or cover was clamped onto the open top of the box to prevent the mold from popping or cracking as the vacuum is applied and the moisture is rapidly evaporated. With the combination of the sand at approximately 200° F., 0.75% protein binder coated sand, and approximately 1.5% moisture, there is enough heat in the sand to provide the energy to evaporate all of the moisture at a final vacuum level of approximately 10 Torr or less.

These tests indicated that restraint such as a perforated lid on the sand in a pattern box was needed if rapid drying was to be accomplished with a vacuum.

EXAMPLE 2

The equipment used in Example 1 was also used in Example 2. The basic conditions for these tests were approximately 200° F. sand coated with 0.75% protein binder mixed with 1.6 to 1.8% water as it was placed in the pattern boxes.

The change in temperature in the sand could be used to determine when the mold was dry because the temperature reduction caused by moisture evaporation slowed dramatically as the mold dried. Once the rate of temperature change was less than 0.5° F. in 5 seconds, the mold was sufficiently dry. The rate of drying seems to be largely controlled by the rate of pressure reduction. With the equipment used in these tests, a 50 pound mold could be sufficiently dried with 5 minutes of vacuum drying. The vent openings did not have a significant effect on the drying rate. It appeared the porosity of the sand is the limiting factor in the rate of water vapor flow out of the mold. If the rate of pressure reduction is slowed significantly, the mold does not pop or crack since the rate of water vapor movement through the mold does not exceed the porosity of the sand.

The cope mold pattern box was used for shake-out test molds, and approximately 50 pounds of sand were held in each mold. The dimensions of the cope mold pattern box were 14 ½ by 14 ½ by 5 inches. There were two holes drilled in the side of the box for thermocouples, one approximately 25% down from the top of the box and the other about 75% down from the top. Thermocouples were placed in the boxes after they were filled with sand and placed in the vacuum bell. There were originally 11 ½ inch slot vents in the box to allow air, steam, and etc. to vent out of the box. This is shown in FIG. 5. An additional 21 holes were drilled for ½ inch vents. This is shown in FIG. 6. Once those holes were drilled, plugs were used in the new holes when it was desired to use the original 11 vent configuration.

In FIGS. 5 and 6, the pattern box 200 includes a first side 201*a*, a second side 201*b*, a third side 201*c*, a fourth side 201*d*, and a fifth side 201*e*. The first side 201*a* forms the bottom of the pattern box 200, and sides 201*b–e* extend upward from the first side 201*a* to form a cavity into which the sand mold mixture is placed. The first side 201*a* includes a pattern 204, and when the sand mold is formed, the sand mold forms around the pattern 204. When the sand mold is then used, the pattern is then formed. In FIG. 5, the original vents 202 are shown. In FIG. 6, both the original vents 202 and the additional vents 203 are shown.

520 silica sand (approximately 63 gfn) coated with 0.75% protein binder was used. The sand was heated with a sand heater with a set point at 180° F., and the actual sand temperature was approximately 200° F. Hot sand was mixed in a continuous Palmer mixer with water at a rate of approximately 160 pounds per minute (30 Hz) with water at a rate of approximately 1475 ml per minute (700 pump setting). This was about 2% moisture. Samples were taken as the sand was filling the pattern box, and the samples contained 1.6 to 1.8% moisture due to evaporation as the hot, moist sand exited the mixer.

Figure 4:
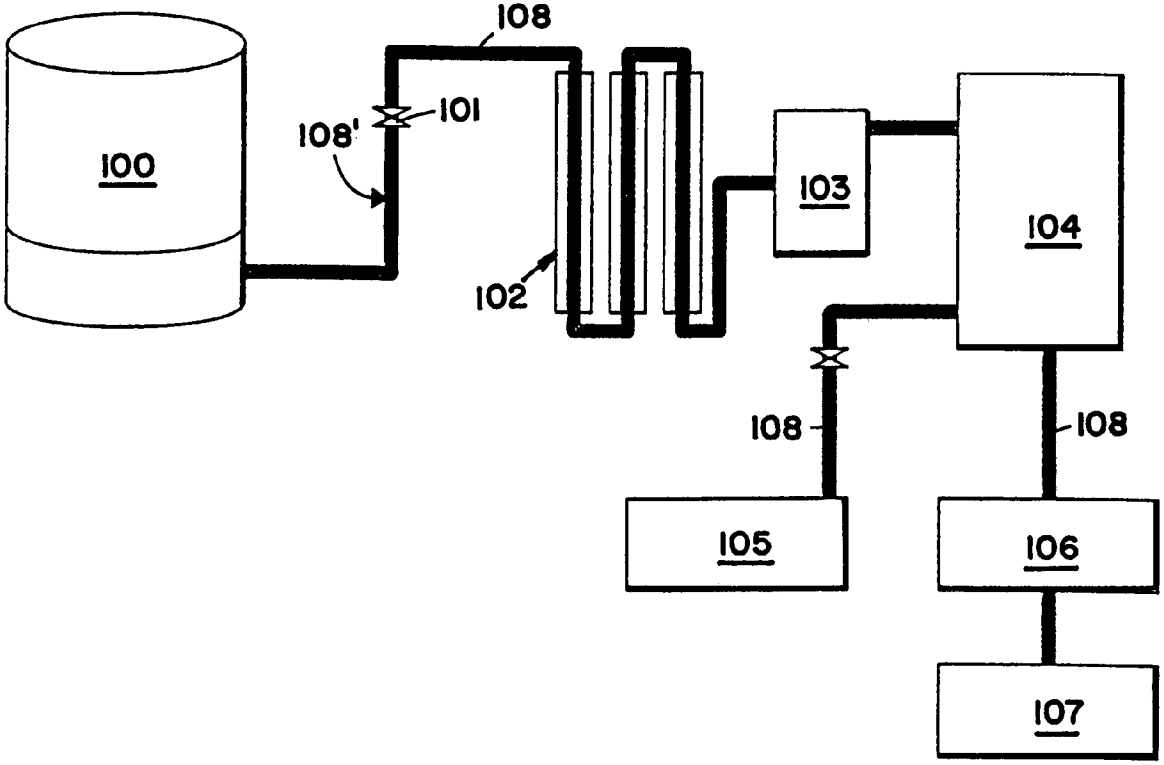
FIG. 4 is a schematic view of a vacuum system for use with the present invention.

FIG. 4 shows the vacuum chamber and system connections used in these tests. There were three vacuum pumps used during the various tests. A liquid ring vacuum pump 107 with a 10 horsepower motor, a booster vacuum pump 106 mounted on the liquid ring vacuum pump 107 inlet, and an oil-sealed vacuum pump 105 were used. A vacuum chamber 104 was connected to the vacuum pumps, and a filter 103 interconnected the vacuum chamber 104 and a condenser 102 with a glycol chiller. Pressure sensors were mounted in the vacuum chamber 100 and the vacuum line 108. The vacuum chamber 100 was about 6 feet in diameter and about 6 feet tall with a metal grate about 12 inches above the bottom of the chamber that supports the pattern boxes. In these tests, the vacuum was drawn from all around the pattern boxes. In the tests, a 6 inch valve 101 was closed in the vacuum line 108 proximate the outlet of the chamber 100. A maximum vacuum was achieved in the vacuum line of about 1 Torr. The vacuum was measured with the pressure sensor in the vacuum line 108. With the pattern boxes in the chamber 100 and the bell lowered, the vacuum valve 101 was opened slowly over a period of 45 to 60 seconds to evacuate the chamber 100. The valve 101 had to be slowly opened to avoid overloading the booster pump 106 since both vacuum pumps 106 and 107 were running during this test.

The vacuum bell was set up for reducing the pressure in the bell as fast as possible with the 6 inch valve 101 leading to the chamber 100 closed and all three vacuum pumps 105, 106, and 107 running to evacuate the system before the valve 101. The pattern box was filed, covered with a perforated lid, and placed in the bell which was then closed. The vacuum was applied to the bell over about 45 seconds by opening the 6 inch valve while leaving all the pumps running. Three tests were run with the vacuum applied for 3, 5, and 7 minutes. The vacuum was released and the molds immediately removed from the boxes and cut to take a sample of sand from the interior of the thickest section for moisture measurement. During the tests, the temperature of the sand was monitored every five seconds by RTD temperature probes inserted through holes in the side of the box. In these tests, the pattern box had the original configuration of eleven ½ inch slot vents. The results listed in Table 1 indicate that the mold was completely dry at 5 minutes of vacuum application. Once the rate of temperature decline in the mold reaches less than approximately 0.5° F. per 5 seconds, the cooling effect of moisture loss through evaporation was largely finished, and the mold was sufficiently dry.

TABLE 1

Vacuum Drying Time for Sand Molds

| | 3 Minutes | 5 Minutes | 7 Minutes |
|---|---|---|---|
| Initial Sand Moisture | 1.89% | 1.61% | 1.78% |
| Moisture in Finished Mold | 0.45% | 0.07% | 0.08% |
| Initial Mold Temperature | 149° F. | 149° F. | 149° F. |
| Final Mold Temperature | 88° F. | 73° F. | 75° F. |
| Rate of Temperature Change at the End of Vacuum Time (° F./5 sec.) | 1.3° F. | 0.3° F. | 0.2° F. |

The rate of vacuum application of the bell was adjusted by changing the size of the pipe section 108' to the bell where the vacuum system was attached, between the 6 inch valve 101 and the vacuum chamber 100. There are several options for changing the rate of vacuum applications. First, a 2 inch pipe section could be used between the 6 inch valve 101 and the vacuum chamber 100. With this option, there are several variables. The 6 inch valve 101 could be opened in steps. The preferred embodiment opened the valve 101 fully over about 45 to 60 seconds. In addition, a plate with a hole in it could be placed in the 2 inch line. Holes having diameters of ⅜ inch, ½ inch, and ¾ inch were tested. Two or three vacuum pumps could be used. Second, a 6 inch pipe section was used with all three vacuum pumps to get a maximum rate of pressure reduction. Three vacuum pumps 105, 106, and 107 were used in the preferred embodiment with the 6 inch pipe section and the valve 101 was fully open for the maximum pressure reduction rate. Otherwise, the liquid ring vacuum pump 107 and the booster vacuum pump 106 were used with all other tests.

Once the options for reducing the rate of vacuum application were established with an empty vacuum bell, several of these options were tried with a mold in the vacuum bell. In this testing the pattern box was placed in the bell either with or without the perforated lid on the pattern box. This allowed whether the rate of vacuum application affected the tendency for the mold to pop or crack without a lid restraining the sand in the pattern box to be determined. The results are in Table 2.

TABLE 2

Rate of Vacuum Application

| Test | Vacuum Restriction | Time to 20 Torr (min.) | Time to Dry (min.) | Initial Moisture | Lid | Mold Quality |
|---|---|---|---|---|---|---|
| 1 | none | 2.0 | 4.7 | 1.67% | no | cracked |
| 2 | none | 2.5 | 5.0 | 1.61% | yes | okay |
| 3 | 2 inch pipe | 4.7 | 6.5 | 1.76% | no | cracked |
| 4 | ¾ inch orifice | 7.0 | 7.5 | 1.71% | no | cracked |
| 5 | ½ inch orifice | 12.0 | 11.0 | 1.48% | no | okay |
| 6 | 6 inch valve at 1 notch | >35.0 | >35.0 | 1.89% | no | wet |

The results indicate that in order to achieve a fast drying mold using a vacuum, a lid is necessary to restrain the sand in the pattern box. The porosity of the sand appears to be low enough that the large volume of water vapor that is formed during rapid vacuum drying cannot move through the sand without causing it to pop and crack. When the air flow out of the bell is severely restricted as when the 6 inch valve was just open one notch or the ⅜ inch orifice plate was used, the mold will not dry at all. Even though the pressure eventually is reduced in the empty bell with these restrictions, this does not happen when there is a mold in the bell. Apparently the water vapor forming in the bell is enough to keep the pressure in the bell close to atmospheric pressure and the mold dries very slowly.

It was hypothesized that the number and the percentage of open area of the vents in the bottom of the pattern box would have a significant effect on the rate of mold drying since more vent openings would allow water vapor to more quickly escape from the mode. In addition, more open area in the pattern box would expose more of the sand mode mixture to vacuum thereby also drying the sand mold more quickly. To confirm this hypothesis, a series of molds having different vent types and configurations were made. An additional 21 vents (totaling 32 vents) having ½ inch diameters were added to the bottom of the cope pattern box and both slot vents (approximately 13% open area) and Shalco vents (approximately 43% open area) were used. Again, the preferred vent configurations are shown in FIGS. 5 and 6. However, it is recognized that the specific sizes and the specific locations of the vents are not controlling. In addition, molds were made with both perforated and solid lids on the pattern boxes during drying. The vacuum system had a 2 inch pipe outlet and used the liquid ring vacuum pump and a booster vacuum pump. The results are shown in Table 3.

TABLE 3

Effect of Vent Openings on Mold Drying

| Test | Type of Vent | # of Vents | Open Area (sq. in.) | Lid | Initial Moisture |
|---|---|---|---|---|---|
| 1 | slot | 11 | 0.28 | perforated | 1.8% |
| 2 | slot | 11 | 0.28 | solid | 1.6% |
| 3 | slot | 32 | 0.82 | perforated | 1.8% |
| 4 | slot | 32 | 0.82 | solid | 1.8% |
| 5 | Shalco | 32 | 2.70 | perforated | 1.6% |
| 6 | Shalco | 32 | 2.70 | solid | 1.8% |

Surprisingly, the drying rates were the same for all the tests as shown by the time to reach a temperature change of less than 0.5° F. in 5 seconds. Apparently the rate of the pressure drop and the porosity of the sand is the controlling factor in how fast the mold will dry. The rate of temperature change in the sand mold during vacuum drying is shown in FIG. 2, which is consistent with FIG. 1 of Example 1.

EXAMPLE 3

Testing was performed to determine the amount of restraint, the maximum size of the apertures in the restraining member, needed to prevent "popping" or cracking of the mold during the drying process. The maximum size of the apertures for making a good mold depends upon several factors including the amount of sand used, the size of the sand particles, the amount of moisture in the sand, the temperature of the sand, and the amount of vacuum applied to the mold.

Because different shapes of apertures may be used, the hydraulic radii of the apertures in different restraining members were used to compare the effect of the size of the apertures in the restraining member (the amount of restraint) regardless of the specific shapes of the apertures. The hydraulic radius is the area of the aperture divided by the perimeter of the aperture. For example, the hydraulic radius of a circular aperture is the area divided by the circumference. The maximum hydraulic radius that produced an acceptable mold was about 0.5 inch, which corresponds to a circular aperture 2 inches in diameter, for a mold containing approximately 80 pounds of sand. As the mold size increased to approximately 250 pounds of sand, the maximum hydraulic radius for producing a good mold was about 0.25 inch, which corresponds to a circular aperture 1 inch in diameter. It is hypothesized that the aperture size needs to be reduced with the increase in the mold size because the amount of moisture and "steam" created is increased when the vacuum is applied.

This example utilized a multi-level box mold with the equipment used in Examples 1 and 2. The multi-level box mold was slightly tapered outward from bottom to top. The bottom level included a bottom and fours sides, and the dimensions of the top of the bottom level were 21 ¼ by 18 3/16 inches. The additional levels included four sides corresponding with the four sides of the adjacent level(s), the four sides of each level being stackable upon one another to increase the depth and the volume of the box mold. The box mold included four levels, three of which were removable to vary the depth and the volume of the box mold while maintaining an open area at the top of the box mold. The dimensions of the top of the second level were 21 15/16 by 18 15/16 inches. The dimensions of the top of the third level were 22 9/16 by 19 9/16 inches. The fourth level was not used. One and three box levels were used for the box molds, and the moist, hot sand was placed into the box molds.

The basic conditions for this example was also approximately 200° F. sand coated with 0.75% protein binder mixed with 1.6 to 1.8% water as it was placed in the pattern boxes. The bottom of the pattern box had 11 slot vents ½ inch in diameter, the pattern area and the number of vents was similar to the shake out mold pattern boxes used in Examples 1 and 2. Once the box molds were filled and leveled, a lid was clamped onto the top of the box molds, thermocouples were inserted, the bell was closed, and the vacuum was applied as rapidly as possible. The vacuum was maintained for 10 to 12 minutes to dry the molds. A variety of lids were used to provide a variety of different apertures having different sizes, shapes, hydraulic radii, and open area to determine the effectiveness of the restraint under rapid vacuum drying.

Apertures of different sizes and shapes were used in the lids covering the boxes using one level (approximately 80 pounds of sand), two levels (approximately 165 pounds of sand), and three levels (approximately 250 pounds of sand). A similar total amount of open area of approximately 41 square inches was used for most of the tests. The results are shown in Table 4.

TABLE 4

Comparison of Apertures with Different Shapes and Sizes

| Shape | # of Apertures | Size (inches) | # of Box Levels | Hydraulic Radius (inches) | Total Open Area (square inches) | Mold Quality |
|---|---|---|---|---|---|---|
| Round | 208 | 0.5 diameter | 1 | 0.125 | 41 | Good |
| Round | 208 | 0.5 diameter | 2 | 0.125 | 41 | Good |
| Round | 208 | 0.5 diameter | 3 | 0.125 | 41 | Good |
| Round | 208 | 0.5 diameter | 3 | 0.125 | 41 | Good |
| Rectangular | 91 | 0.3 × 1.5 | 3 | 0.125 | 41 | Good |
| Round | 52 | 1.0 diameter | 1 | 0.25 | 41 | Good |
| Round | 52 | 1.0 diameter | 3 | 0.25 | 41 | Some Popping; Not Good |
| Round | 52 | 1.0 diameter | 3 | 0.25 | 41 | Good |
| Rectangular | 23 | 0.6 × 3.0 | 3 | 0.25 | 41 | Good |
| Round | 13 | 2 diameter | 1 | 0.5 | 41 | Some Popping; Good |
| Round | 13 | 2 diameter | 3 | 0.5 | 41 | Popping; Not Good |
| Rectangular | 1 | 3 × 17 | 3 | 1.28 | 51 | Popping; Not Good |
| Rectangular | 2 | 7 × 17 | 3 | 2.48 | 238 | Popping; Not Good |
| No Lid | 1 | 17 × 17 | 1 | 4.25 | 289 | Popping; Not Good |

The results show that with a one level box, a good mold could be made with the 0.5 inch hydraulic radius, a 2 inch diameter round aperture, although the top of the box had some distortion. With a 0.25 inch hydraulic radius aperture, a 1 inch diameter round aperture, the mold had no defects. With a three level box, the maximum hydraulic radius to make a useable mold was 0.25 inch with both round and rectangular slotted apertures. At the 0.25 inch hydraulic radius, there was one instance where sand blew out of a lid opening during vacuum drying, ruing the mold. Therefore, 0.25 inch may be a border-line hydraulic radius for larger amounts of sand.

EXAMPLE 4

Testing was also performed to evaluate the vacuum drying characteristics of a mold box having a different shape than the mold box used in Example 3. The test procedure of Example 3 was followed in this example. The mold box used in this test was designed to hold approximately 250 pounds of sand at a depth of 5 ½ inches. This depth is the same as the one layer box used in Example 3 but the mold box in this test had a length and a width of 26 ¾ inches by 26 ¾ inches. A first test used 13 round apertures, each having a 2 inch diameter, and a second test used 52 round apertures, each having a 1 inch diameter. The results are shown in Table 5.

TABLE 5

| Vacuum Drying of Different Shape of Mold Box | | | | | | |
|---|---|---|---|---|---|---|
| # of Apertures | Diameter (inches) | # of Box Levels | Sand Weight (pounds) | Hydraulic Radius (inches) | Total Open Area (square inches) | Mold Quality |
| 13 | 2 | 1 | 250 | 0.5 | 42 | Popping; No Good |
| 52 | 1 | 1 | 250 | 0.25 | 41 | Good |

As shown in Table 5, in the first test, the mold popped and cracked during the vacuum drying resulting in an unacceptable mold. In the second test, the mold dried uniformly without popping or cracking resulting in an acceptable mold.

From the test results of Examples 1–4, it was determined that the use of a restraining member on open mold boxes allows fast vacuum drying of sand molds made with water-based binders while reducing the occurrence of cracks and/or voids in the sand molds. The present method could be used in making sand molds for use in metal casing with any binder that relies upon the removal of water to cure or harden. Again, it is recognized that the present invention may also be used on sand molds made with solvent-based binders that must evaporate to cure or harden.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A method of making a sand mold, comprising:

a) placing a sand mold mixture containing moisture into a pattern;

b) restraining the sand mold mixture in the pattern; and c) exposing the sand mold mixture to a vacuum, the vacuum being low enough to flash off the moisture in the sand mold mixture thereby drying the sand mold mixture to create a sand mold, the restrained sand mold mixture preventing voids in the sand mold.

2. The method of claim 1, the vacuum being less than 100 Torr.

3. The method of claim 2, the vacuum being preferably 4 to 5 Torr.

4. The method of claim 1, the sand mold mixture being exposed to the vacuum for less than 30 minutes.

5. The method of claim 1, further comprising heating the sand mold mixture before placing the sand mold mixture into the pattern.

6. The method of claim 5, the sand mold mixture being at least 140° F. when placed into the vacuum chamber.

7. The method of claim 1, the sand mold mixture containing approximately 1.5 to 2.0% moisture by weight of the sand mold mixture when placed into the pattern.

8. A method of making a sand mold, comprising:

a) placing a sand mold mixture containing moisture into a pattern;

b) placing a restraining member onto the pattern, the restraining member restraining the sand mold mixture within the pattern; and c) exposing the restrained sand mold mixture filled pattern to a vacuum, the vacuum being low enough to flash off the moisture in the sand mold mixture thereby drying the sand mold mixture to create a sand mold, the restraining member preventing voids in the sand mold.

9. The method of claim 8, further comprising heating binder coated sand and mixing the binder coated sand with water to create the sand mold mixture.

10. The method of claim 8, the binder coated sand being heated to approximately 180 to 200° F.

11. The method of claim 8, the sand mold mixture being at least 140° F. when placed into the pattern.

12. The method of claim 8, further comprising heating water to approximately 150° F. before mixing the water with the binder coated sand.

13. The method of claim 8, the vacuum being less than 100 Torr.

14. The method of claim 13, the vacuum being preferably 4 to 5 Torr.

15. The method of claim 8, the sand mold mixture being exposed to the vacuum for less than 30 minutes.

16. The method of claim 8, the restraining member including apertures having a hydraulic radius of 0.5 inch or less.

17. The method of claim 8, the sand mold mixture containing approximately 1.5 to 2.0% water by weight of the sand mold mixture when placed into the pattern.

18. A method of making a sand mold, comprising:

a) placing a sand mold mixture containing moisture into a pattern;

b) restraining the sand mold mixture in the pattern by placing a perforated lid on the pattern, the perforated lid having apertures with a hydraulic radius of 0.5 inch or less; and c) exposing the pattern containing the sand mold mixture to a vacuum, the vacuum being low enough to flash off the moisture in the sand mold mixture thereby drying the sand mold mixture to create a sand mold, the perforated lid preventing voids in the sand mold.

19. The method of claim 18, further comprising heating the sand mold mixture before placing the sand mold mixture into the pattern.

20. The method of claim 18, the vacuum being less than 100 Torr.

21. The method of claim 20, the sand mold mixture being exposed to the vacuum for 30 minutes or less.

22. The method of claim 18, the sand mold mixture containing approximately 1.5 to 2.0% moisture by weight of the sand mold mixture when placed into the pattern.

* * * * *